United States Patent [19]

Maciejewski

[11] 4,339,339

[45] Jul. 13, 1982

[54] HYDROSTATICALLY DAMPING AND SHOCK ABSORBING NON-VULCANIZABLE POLYSILOXANE AND BORON COMPOUND FOR MECHANICAL ENERGY ABSORPTION

[76] Inventor: Jeremi Maciejewski, A1. Niepodleglosci Str. 142A/6, Warszawa, Poland

[21] Appl. No.: 237,683

[22] Filed: Feb. 24, 1981

Related U.S. Application Data

[63] Continuation-in-part of Ser. No. 69,274, Aug. 24, 1979, which is a continuation-in-part of Ser. No. 904,499, May 10, 1978, abandoned.

[30] Foreign Application Priority Data

May 10, 1977 [PL] Poland ..... 198004

[51] Int. Cl.[3] ..... C08G 77/38; C08G 77/44; C08G 77/56; F16F 9/30

[52] U.S. Cl. ..... 252/75; 252/78.3; 525/474; 525/477; 528/30; 556/402

[58] Field of Search ..... 252/75, 78.3; 260/37 SB; 525/474; 528/5, 8, 30; 556/402

[56] References Cited

U.S. PATENT DOCUMENTS

| | | | |
|---|---|---|---|
| 2,541,851 | 2/1951 | Wright | 260/37 SB |
| 3,177,176 | 4/1965 | Boot et al. | 260/37 SB |
| 3,213,048 | 10/1965 | Boot | 260/37 SB |
| 3,231,542 | 1/1966 | Eisinger | 260/37 SB |
| 3,551,377 | 12/1970 | Andrianov | 528/30 X |
| 3,623,942 | 11/1971 | Yerrick | 260/37 SB |
| 3,772,240 | 11/1973 | Greenlee | 260/37 SB |
| 3,801,535 | 4/1974 | Joschko | 260/37 SB |
| 3,855,171 | 12/1974 | Wegehaupt | 528/30 X |

*Primary Examiner*—Dennis L. Albrecht

[57] ABSTRACT

The invention relates to a liquid non-vulcanizable polysiloxane and boron compound for use for hydrostatically damping and shock absorbing mechanical energy in apparatus of various types, as for instance in bump stops for elevators and overhead jib cranes, fenders for vehicles and the like. The composition for mechanical energy absorption comprises boro siloxane polymers, fillers, pigments and alkyl-aryl-siloxane oils.

6 Claims, No Drawings

HYDROSTATICALLY DAMPING AND SHOCK ABSORBING NON-VULCANIZABLE POLYSILOXANE AND BORON COMPOUND FOR MECHANICAL ENERGY ABSORPTION

RELATED APPLICATION

The present application is a continuation-in-part of Ser. No. 69,274, filed Aug. 24, 1979, which, in turn, is a continuation-in-part of Ser. No. 904,499, filed May 10, 1978, now abandoned, the subject matter of both of which is incorporated herein by reference.

The invention relates to a liquid non-vulcanizable polysiloxane and boron compound for hydrostatic absorption of mechanical energy in various mechanical energy absorbing devices, such as bump stops for elevators and overhead jib cranes, fenders for mechanical vehicles, and the like, as well as in devices serving simultaneously as vibration dampers and absorbers for collision energy.

Prior compositions or compounds applied for absorption of mechanical energy contained, as the main components, aliphatic alcohols, glycols, mineral oils, silicone oils, rubber and pastes, depending on their use.

Disadvantages of these compounds or compositions are that they are capable of serving only either as vibration dampers or as absorbers for collision energy and that they are useful only over a relatively narrow range of temperatures. Change is temperature of the environment or of the composition itself, resulting in transformation of mechanical energy to heat energy, significantly alters the rheological properties of such prior art products. oreover, rheological properties of previously know compounds or compositions for absorbing mechanical energy are also slightly dependent on mechanical forces. Although the apparent viscosity of silicone oils decreases with increasing energy of vibrations thus making an exception to this general rule, the resulting change in their rheological properties is undesirable.

For instance, according to Polish Patent specification No. 87879, a vibration damping composition consists of synthetic resins and mineral fillers; and the composition described in Polish Patent specification No. 71440 consists of vulcanizable silicone oil, silicone oils of other types and mineral fillers. The compositions of the aforementioned kinds are capable of damping vibrations of very low energy, as for instance, those resulting from the playing of gramophone records, but are completely useless for absorption of mechanical energy developed during braking action on overhead jib cranes or elevators.

Other compositions, described as hydraulic fluids in Polish Patent specifications Nos. 59560 and 51768, are based on aliphatic alcohols, including polyhydroxy alcohols, and may be used for damping vibrations in special devices only.

Various molds and plates manufactured of vulcanized organic rubbers are also applied for absorption of mechanical energy. Compositions of this kind absorb very limited amounts of energy only, and the stopping distance is no longer than a few centimeters. The collision is always elastic, and, at higher collision energies, both the bump stop and the device checked are damaged.

Application of compositions of silicone oils of high and low viscosity, as have been commonly used for damping vibrations, requires, because of their specific rheological properties, a special design and precise manufacture of the devices used so that the oil can be pumped through the narrow ducts between the chambers of such energy absorber devices, and, therefore, cost of the production of such devices is rather high.

From U.S. Pat. No. 2,541,851, the composition of boromethyl-siloxane polymer, lithopone, benzoyl peroxide and zinc oxide, which is of the bouncing putty type, is known. The polymer is obtained by the condensation of an unidentified dimethylsilicone oil and or pyroboric acid in the presence of $FeCl_3,6H_2O$ as the catalyst. This composition is intended for use in gaskets and acoustic applications, and in the manufacture of (golf, tennis, etc.) balls. The composition is entirely unsuitable for the absorption of mechanical energy because its rheological characteristic is unstable, i.e., the changes in viscosity effected by external forces and temperature changes are so vast that an energy absorber (containing such composition) would not stand up to performance requirements at temperatures ranging from $-40°$ to $+150°$ C. Moreover, the presence of the residual catalyst ($FeCl_3$) in the composition would result in a degradation of the polymer at elevated temperatures.

Borosiloxanes known from U.S. Pat. No. 3,177,176 (to R. J. Boot) are identical with the bouncing putty described in the patent last mentioned, the difference being that, in this case, the borosiloxanes are synthesized from other boron compounds. Applications foreseen for this polymer are also the same as those for the product described above. This product is also entirely unsuitable for mechanical energy absorption. Rheological characteristic of this bouncing putty is unstable over a wide temperature range: the polymer freezes at $-10°$ C. under the pressure of 3000 bars. Elasticity of this composition as measured in the rebound test amounts to, according to the patent, 76%. It means that the composition confined within a mechanical energy absorber would not flow under the action of forces.

The composition known from U.S. Pat. No. 3,213,048 (to R. J. Boot) for all practical purposes does not differ from the products obtained according to the above discussed patents. The patent underscores that a silanol chain-stopped polydiorganosiloxane is to be cross-linked cured with an organo borate. The composition is modified with glycerol and oleic acid with the result that the rebound is lower than that stipulated by U.S. Pat. No. 3,177,176. Nevertheless, use of the composition is still limited to those uses typical for bouncing putty applications.

This composition is also unsuitable for mechanical energy absorption since, similarly to the other prior compositions listed above, it displays unstable rheological characteristics: it will freeze at a temperature of $-10°$ C. under a pressure of 3000 bars and the inclusion of glycerol results in a composition which, at the temperature of 150° C., becomes a low viscosity liquid.

From the description in Product Engineering (January 1950), article entitled "Silicone Putty", the applications of bouncing putty in piston type dampers are known. These disclosures, made by General Electric Co., the manufacturer of the bouncing putty, as illustrated in FIGS. C and D (page 93) of the publication, are not very specific in indicating basic deficiency of these piston dampers, viz., that the vibration damping efficiency thereof is limited to low frequencies where the bouncing putty is in its liquid like behavior range. With increasing frequency of vibrations, bouncing putty becomes more and more elastic, approaching in its behavior that of metal springs. Thereby, bouncing putty ceases to damp the vibrations and starts to propagate stresses to the construction. For this reason, bouncing putty not only did not find wide-spread applications in vibration damping but, obviously, also did not find applications as the energy absorbing material in shock (impact) absorbers. The absorption of mechanical energy is associated with plastic flow of the visco-elastic absorption composition as realized under forces acting on an absorber's plunger during its displacement within the cylinder of an absorber. Should such a flow be prevented, the shock absorber chamber will burst.

Confirmation of such a state of the art comes from the fact that the inventions pertaining to bouncing putty, 10 years after the above quoted publication, do not mention the possibility of mechanical energy absorption in site of the fact that the inventions originated also in General Electric Co. (R. J. Boot).

There are known and widely exploited polysiloxane compositions, containing bouncing putty, used in the manufacture of self-adherent silicone rubbers which are vulcanized on rubber bands and tapes used for electrical insulation. These compositions consist of generally known silicone rubber of dimethyl-, methylphenyl- or methyl-phenyl-vinyl siloxane type which forms (upon vulcanization and the addition of reinforcing fillers) a silicone rubber of improved mechanical performance. To such a silicone rubber, 10 to 30 wt % of bouncing putty is introduced in order to induce, upon vulcanization, the self-adherent characteristic of the rubber.

Manufacturing techniques as well as the composition of such a rubber are described in great detail by U.S. Pat. No. 3,629,183, in which it is indicated that, to the polysiloxane rubber (column 2, point a), 4 to 12 parts by weight of an elastic composition containing boron is introduced. Remaining additives such as fillers, organic peroxides and plasticizers are used in order to impart self-adherent properties to the vulcanized silicone rubber. In the description, application of the composition and the properties of the self-adherent tapes manufactured therefrom are set forth clearly. The composition described in the patent, both in the vulcanized form and prior to vulcanization, could not be used for mechanical energy absorption applications. Properties of the composition, in spite of its extrudability, preclude plastic flow required in mechanical energy absorbers. Such a composition, when compressed up to high pressures, freezes at −20° C. and, on the other hand, will undergo crosslinking as the result of heating caused by prolonged conversion of mechanical (shocks) energy into heat. Moreover, the addition of silica gel causes hardening of the unvulcanized composition.

The polysiloxane compositions containing boron or bouncing putty, intended for applications as self-adherent (upon vulcanization) silicone rubbers, are known from U.S. Pat. Nos. 3,231,542 and 3,772,240. Various manufacturing techniques are described therein yet, in the end, the same silicone rubber, designated for production of either moldings of enhanced adhesion or self-adherent products, is obtained. Attempts to apply the compositions as the viscoelastic media for shock absorbers could not lead to any effective results.

The polysiloxane composition known from U.S. Pat. No. 3,855,171 (to K. H. Wegehaupt) is also, as related by the patentee, intended for use with self-adherent rubbery tapes which are said to have adequate mechanical properties. The patentee compounds a (methyl-vinyl-silicone) polymer of viscosity of $10^6$cPs with an unidentified dimethylsilicone polymer containing Si-OH groups and with boron compounds. He is carrying out the process for bouncing putty production in a high molecular environment—that of the methyl-vinyl-silicone polymer. Simultaneous introduction of silica gel yields, in a single operation, silicone rubber mixed with bouncing putty. In Example 2, the patentee describes how bouncing putty is to be synthesized in order to be introduced later on into polymers differing in structure, e.g., methyl-phenyl-silicone or methyl-phenyl-vinyl silicone polymers which are suitable for vulcanization into rubber, which, if it contains bouncing putty, would display self-adherent characteristics. Since the polymer obtained is a random copolymer of unknown structure, and hence of unknown rheological characteristics, it, therefore, is entirely unsuitable for manufacturing compositions designed for mechanical energy absorption, which are used, in unvulcanized form. The composition described in the patent contains significant amounts of colloidal silica gel and other fillers. As was described earlier, such composition will not flow in the mechanical energy absorbers. Moreover, prolonged storage of the composition causes interaction of SiOH groups contained in the polymer and in silica gel, which results in rapid hardening as is observed for silicone rubber compounds and which necessitates replasticization.

From U.S. Pat. No. 3,623,942 (to Yerrick), a method for vibration damping is known: damping is realized by use of elastic silicone rubbers of methyl phenyl silicone type. As follows from the patent description, the damping is possible after the composition is vulcanized and plasticizing additives introduced. The rubber described by the patentee could not be used for filling mechanical energy absorbers, since it would not flow in the cylinder in which the plunger is to be displaced. Moreover, the polymers from which the rubbers are obtained are random (statistical) copolymers of unidentified rheological behavior, which freeze under high pressures at the temperature of −20° C. and harden during storage even when unvulcanized.

According to the present invention, a hydrostatically damping and shock absorbing non-vulcanizable polysiloxane and boron composition for mechanical energy absorption consists of:

(a) 100 parts by weight of polysiloxane polymer which is made by heating a mixture of 3 mols of alkylaryl-polysiloxane diol, where alkyl contains 1 to 10 carbon atoms and aryl from 6 to 10 carbon atoms and which has a freezing temperature of less than −50° C., with from 1 to 50 moles of boron compounds added in the form of a solution in glycerine, which are partially evaporated during the reaction;

(b) from 0.1 to 200 parts by weight of fillers with a specific surface area of 10 to 400 $m^2/g$ by BET Method;

(c) from 0.01 to 300 parts by weight of pigments with a specific surface area not exceeding 200 $m^2/g$/BET/; and (d) from 0.1 to 100 parts by weight of alkyl-alkylaryl-siloxane oils, where alkyl contains 1 to 10 carbon atoms and aryl 6 to 10 carbon atoms and having a viscosity of $1\times10^4$ to $2\times10^6$ cP at 25° C.

According to this invention, the alkyl-aryl-polysiloxane diol used in the preparation of polymer (a) has a viscosity of 2000 to $2\times10^7$ cP at 25° C. This polymer (a) is obtained by heating to 150° C. said polysiloxane diol with a solution containing, e.g., 1 mol boric acid in 5 mols glycerine, which is evaporated in the condensation process. Resulting, is a liquid polymer with viscosity from $50\times10^3$ to $2\times10^7$ cP at 25° C., measured with Weissenberg rheogoniometer at the frequency (cone vibrations with respect to the stationary platen) of 0.01 Hz.

In order to obtain a hydrostatically damping and shock absorbing non-vulcanizable composition for mechanical energy absorption, to the basic polymer (a) taken in 100 weight parts are added from 0.1 to 200 parts by weight of fillers. The filler is a talc or boron nitride. The fillers reduce the viscosity dependence upon temperature, reduce freezing shrinkage and enhance heat conduction. Also included are 0.01 to 300 parts by weight of pigments characterized by having a specific surface area of less than 200 $m^2/g$ as measured by the BET method. The pigments allow for close fit of the composition viscosity to the requirements of the equipment in which the composition is to be used, reduce the shrinkage of the composition, enable coloring of the composition and prevent the degradation of the polymer under the influence of heat generated during operation of the absorbers in which mechanical energy is converted into heat. The pigment is a molybdenum disulphide, graphite or a powdered metal. In order to augment the viscous contribution to the composition without appreciable increase in the elastic contribution, to each 100 parts by weight of the polymer from 0.1 to 100 parts by weight of a dialkyl- or alkyl-aryl-silicone oil are added. In these oils, alkyl groups contain from 1 to 10 carbon atoms whereas the carbon atom content in the aryl groups is between 6 and 10; preferably methyl-silicone oils having a viscosity ranging from 10000 to $2\times10^6$ cPs at 25° C. are added.

For the compositions to be used at high pressures and at temperatures below −25° C., preferably methyl-phenyl-silicone copolymers characterized by having a freezing temperature below −110° C. should be used. Silicone oils incorporated into the compositions enhance the long term performance of mechanical energy absorbers in which these compositions are used.

The following examples will illustrate this invention:

EXAMPLE 1

A composition for filling devices used in damping or absorbing the high energy evolved during collisions of railway cars, automobiles, recoil of cannon barrels and rocket launchers, etc. is manufactured as follows:

(a) Preparation of the polymers: Polycondensation of 100 g of polydimethylsiloxane-diol (DC-02-1101, Dow Corning) having a viscosity of 100 cPs at 25° C. with 0.1 g of methyl-phenyl-silanediol and 0.1 g of acid diatomaceous earth was carried out in a flask furnished with stirrer and thermometer at 100° C. for 2 hours. Then the catalyst was filtered from the resulting copolymers, 5 g of boric acid in 37 g glycerine were added, and the mixture was warmed for an additional 2 hours. The reaction yielded an elastic polymer having a viscosity of 8,000,000 cPs at 25° C.; it absorbed strongly at about 3200 $cm^{-1}$.

(b) Preparation of the absorption composition: 100 g of the polymer prepared according to (a) was weighed into a mixer and 15 g of talc and 10 g molybdenum disulphide were added with constant mixing. To the thoroughly mixed mixture were added 50 g of methyphenylsilicone oil having a viscosity of 2,000,000 cPs at 25° C. The composition was mixed until complete homogeneity was achieved and warmed up to 100° C. for 30 minutes. After cooling, the composition was used for filling of an absorber of mechanical energy.

EXAMPLE 2

A composition for filling of bump stops for elevators, overhead jib cranes and similar devices, where time of action and the braking distances are rather long, was manufactured as follows:

(a) Preparation of the polymer: A mixture of 100 g of polydimethylsiloxane-diol (DC-02-1101) and 1 g of methyl-phenylsiloxane-diol was condensed in the presence of 0.1 g of acidic diatomaceous earth for 2 hours at 100° C. in a flask furnished with a stirrer and a thermometer. After removing the catalyst by filtration, 5 g of ethyl borate in 37 g glycerine were added, and the reaction mixture was stirred at 120° C. for 2 hours. The resulting copolymer had a viscosity of 300,000 cPs at 25° C. and showed strong absorption at about 3,200 $cm^{-1}$.

(b) Preparation of the absorption composition: 100 g of polymer prepared according to (a), 100 g talc and 15 g of grapite were compounded in a mixer for 15 minutes. 20 g of methyl-phenyl-silicone oil having a viscosity of 1,500,000 cPs at 25° C. were added, and mixing was continued until a homogeneous mixture was obtained. The composition was warmed at 100° for 30 minutes and, after cooling, it was used for filling of bump stops.

EXAMPLE 3

A composition used for filling of energy absorbing devices, equipped with an additional emergency absorber for absorption of energy exceeding the initially assumed amount of energy, was prepared as follows:

(a) Preparation of the polymer: 100 g of polydimethylsiloxanediol with viscosity of 100,000 cPs (25° C.) with 50 g of methyl-phenyl-siloxanediol and 0.1 g of acidic bentonite were stirred at 100° for 2 hours in a flask furnished with a stirrer and a thermometer. After this time, the catalyst was filtered off and the filtrate was warmed with 0.1 g ethyl borate in 0.75 g glycerine for an additional 2 hours. An elastic polymer with viscosity of 2,500,000 cPs (25° C.) was obtained.

(b) Preparation of the composition: The polymer prepared according to (a) (100 g) was weighed into a mixer, and 120 g of talc and 50 g of powdered copper were added. After thorough mixing, 100 g of methyl-silicone oil (DC-200) with viscosity of 200,000 cPs (25° C.) were introduced and mixing was continued for 30 minutes at 120° C. After cooling to 20° C., 2 g of graphite were added and the composition was heated at 150° C. for 15 minutes. The resulting composition was used for filling an additional energy absorber.

Application of the compositions of this invention is especially advantageous in bump stops for railway cars, automotive fenders, landing gears for airplanes, bump stops for gun and rifle barrels, in construction of rocket launchers and so on. To achieve the effect of absorption of energy and damping of vibrations, no elaborate design of devices is necessary and therefore the apparatus for absorption of mechanical energy can be less expensive, lighter in weight by about 30–50% and more reliable. The compositions according to the invention are capable of damping of vibrations and of absorption of mechanical energy within a broad temperature range from −40° C. up to +150° C.

What is claimed:

1. A hydrostatically damping and shock absorbing, non-vulcanizable polysiloxane and boron-containing composition for mechanical energy absorption which is capable of flowing in a cylinder in which the plunger thereof is to be displaced, consisting of:

(a) 100 parts by weight of polysiloxane polymer which is made by heating a mixture of 3 mols of alkyl-aryl-polysiloxane diol, where alkyl contains 1 to 10 carbon atoms and aryl from 6 to 10 carbon atoms and which has a freezing temperature of less than −50° C., with from 1 to 50 moles of boron compounds selected from the group consisting of boric acid and ethyl borate added in the form of a solution in glycerine, which is partially evaporated during the reaction;

(b) from 01 to 200 parts by weight of fillers with a specific surface area of 10 to 400 $m^2/g$ by BET method;

(c) from 0.01 to 300 parts by weight of pigment with a specific surface area not exceeding 200 $m^2/g/BET/$; and (d) from 01 to 100 parts by weight of alkyl-alkyl-aryl-siloxane oils, where the alkyl contains 1 to 10 carbon atoms and the aryl 6 to 10 carbon atoms and having a viscosity of $1\times10^4$ to $2\times10^6$ cP at 25° C.

2. The composition according to claim 1, wherein the alkyl-aryl-polysiloxane diol used in the preparation of (a) has a viscosity of $2\times10^3$ to $2\times10^7$ cP at 25° C.

3. The composition according to claim 1 wherein a solution of 1 mol boric acid in 5 moles of glycerine is used in producing the polysiloxane polymer (a).

4. The composition according to claim 1 wherein the filler (b) is selected from the group consisting of talc and boron nitride.

5. The composition according to claim 1 wherein the pigment (c) is selected from the group consisting of molybdenum disulphide, graphite and a powdered metal.

6. The composition according to claim 1 wherein the alkyl-aryl-siloxane oil (d) is methyl-phenyl-silicone oil.

* * * * *